US006074490A

United States Patent [19]

Brown

[11] Patent Number: 6,074,490

[45] Date of Patent: Jun. 13, 2000

[54] SHOE CLEANING METHOD

[75] Inventor: Stephen Collin Brown, 4103 Offut Dr., Suitland, Md. 20746

[73] Assignee: Stephen Collin Brown, Suitland, Md.

[21] Appl. No.: 09/098,522

[22] Filed: Jun. 17, 1998

Related U.S. Application Data

[60] Provisional application No. 60/049,834, Jun. 17, 1997.

[51] Int. Cl.[7] ..... B08B 1/00; B08B 3/08; B08B 5/04; A47L 23/20

[52] U.S. Cl. ..... 134/6; 134/7; 134/26; 134/30; 134/32; 134/42; 15/34; 15/36; 15/302

[58] Field of Search ..... 134/6, 7, 26, 30, 134/73, 2, 42; 15/34, 36, 302

[56] References Cited

U.S. PATENT DOCUMENTS 4,233,707 11/1980 Leblanc ..... 15/311

5,025,528 6/1991 Burey et al. ..... 15/302

5,839,144 11/1998 Willner ..... 15/36

*Primary Examiner*—Zeinab El-Arini

[57] ABSTRACT

The invention relates to a specialized shoe cleaning method that will clean athletic shoes in such a manner that the newly cleaned shoes resemble brand new shoes. The method or process includes applying a chemical to the outer part of the shoe, agitating the surface dirt via a motorized spinning brush, applying high pressure air to blow off any remaining dirt from the shoe, applying a chemical spray (e.g., for shoes with different type fabric), applying pressurized steam, applying an extraction process, using a specialized tool to extract dirt to clean the interior upper, and applying a drying process to dry the shoes. The application of cleaning solutions, high pressure air and steam in conjunction with the vacuum process is especially suited for the removal of dirt, stains and other foreign matter from the shoes.

13 Claims, 4 Drawing Sheets

SHOE CLEANING METHOD

CROSS REFERENCE TO RELATED APPLICATION

This application is based on Provisional Patent Application Serial number 60/049,834 filed Jun. 17, 1997.

BACKGROUND OF THE INVENTION

1. Field of the Invention

The invention relates generally to cleaning methods. More specifically, the invention relates to a cleaning method useful for cleaning shoes, namely, athletic shoes.

2. Description of Related Art

The shoe industry has emerged as a billion dollar industry. Consumers of all ages pay top dollar for celebrity endorsed athletic footwear. In fact, in some segments of the population, consumers refuse to wear anything but the newest, and often most expensive, athletic style shoe. Many different types of people purchase athletic shoes: some are joggers who need the proper arch support; some are women who use walking shoes to replace high heels on their journey to work; still others are the "serious athletic types" or "weekend warriors" who love to play basketball or other sports; and finally some simply like to wear nice athletic shoes. Though there are different types of consumers who purchase athletic shoes, they all have one trait in common, they like their shoes to be clean. This desire for clean, impressive looking shoes has gone a long way in fueling the growth of the shoe industry. The motivation in purchasing new athletic footwear is not due, in large part, to a desire for the "latest" shoe, but simple in the desire to have clean, nice looking shoes that add to the appearance of the wearer.

Unfortunately, there has never been an apparatus or method of cleaning shoes that was adequate in properly cleaning athletic shoes. The conventional devices or methods never left the shoes looking "brand new", it was always evident that the shoes were simply old shoes that someone had attempted to clean. The failure of the existing shoe cleaning methods forced the consumers to either wear dirty looking shoes, or purchase new expensive shoes when an event called for them to wear nice footwear (e.g., at a social club picnic). Consumers would jump at the opportunity to have their shoes professionally cleaned rather than pay large sums of money to purchase a new pair of shoes simply because their old pair are dirty. No longer would consumers need to waste good money on new shoes when the only flaw in the old shoes was that they were dirty. There is, therefore, need for a method of cleaning athletic shoes that includes the steps of chemical application, dirt agitation, high pressure steam application, high pressure air, shoe buffing, high pressure vacuum application, and shoe drying such that at the conclusion of the method application, the cleaned shoe looks new. The present invention provides such a method.

SUMMARY OF THE INVENTION

The invention relates to a specialized shoe cleaning method that will clean athletic shoes in such a manner that the newly cleaned shoes resemble brand new shoes. The method or process comprises applying a chemical to the outer part of the shoe, agitating the surface dirt via a motorized spinning brush, then applying high pressure air to blow off any remaining dirt from the shoe, applying a chemical spray (e.g., for shoes with different type fabric such as suede), applying pressurized steam, then applying an extraction process, using a specialized tool to clean the interior upper, and finally applying a drying process to dry the shoes. The application of cleaning solutions, high pressure air and steam in conjunction with the vacuum process is especially suited for the removal of dirt, stains and other foreign matter from the shoes.

Accordingly, it is a principal object of the invention to provide a method of cleaning shoes according to the present invention wherein the method is especially adapted to clean athletic shoes.

It is another object of the invention to provide a method of cleaning shoes wherein one of the steps in the method includes the application of chemicals.

It is a further object of the invention to provide a method of cleaning shoes wherein one of the the steps includes application of steam and high pressure air.

Still another object of the invention is to provide a method of cleaning shoes wherein vacuum hoses are employed to remove dirt from the shoes.

It is again an object of the invention to provide a method of cleaning shoes wherein a motorized spinning brush is used to remove surface dirt from the shoe.

It is an object of the invention to provide improved elements and arrangements thereof in method for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
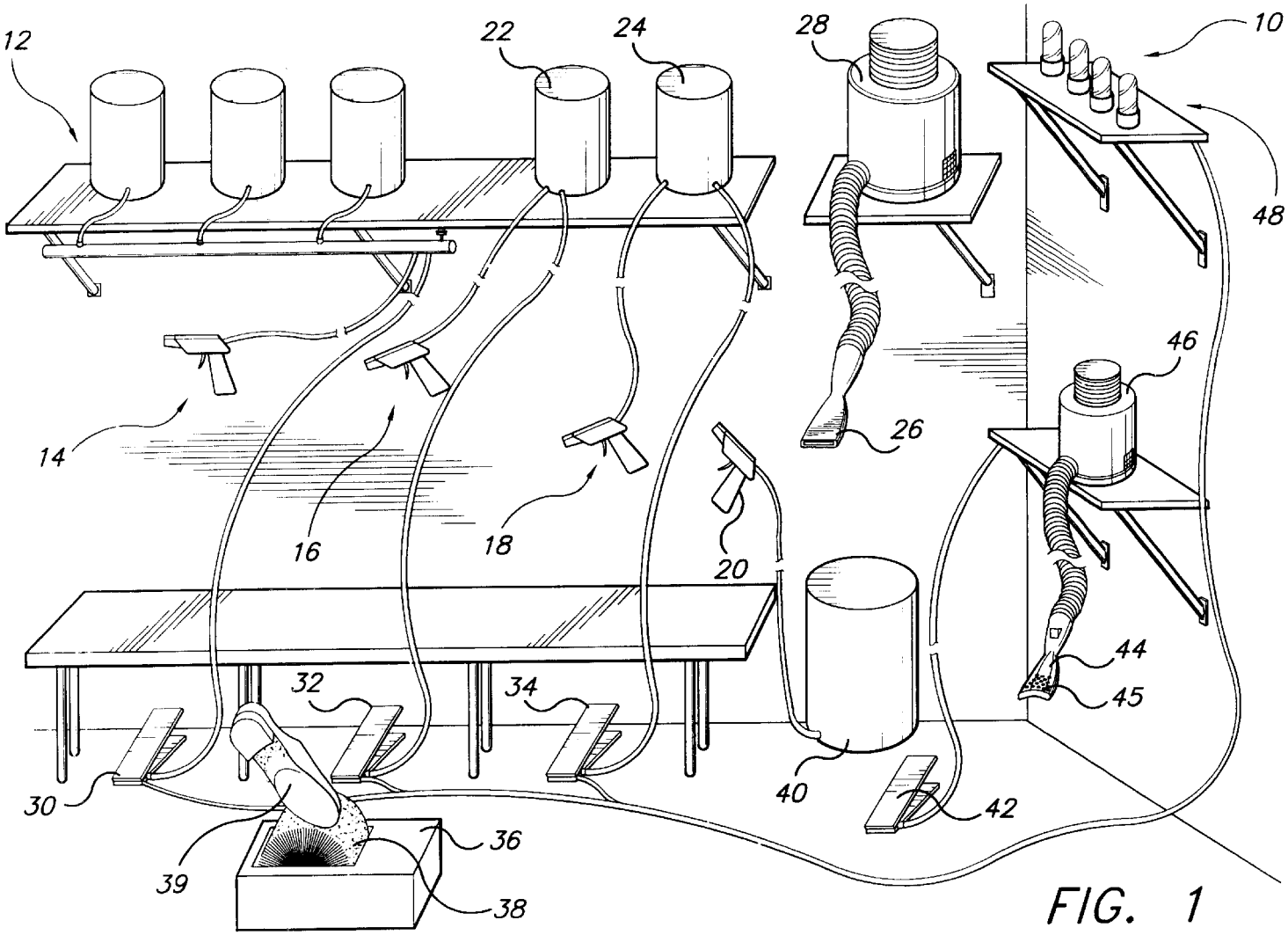
FIG. 1 is an environmental view of the steps and apparatuses used in the method of cleaning shoes.

The invention relates to a specialized shoe cleaning method that will clean athletic shoes in such a manner that the newly cleaned shoes resemble brand new shoes. The method or process comprises, in a first embodiment, the application of a chemical to the outer part of the shoe and then agitating the surface dirt via a motorized spinning brush. After agitating the surface dirt, high pressure air is applied to blow off any remaining dirt from the shoe. A chemical spray (for shoes with different type fabric) is applied followed by the application of pressurized steam. The extraction process, comprising the use of a vacuum to remove any remaining dirt, follows the application of pressurized steam. A specialized tool is next used to clean the interior upper, and finally a drying process is applied to dry the shoes. The aforementioned cleaning process successfully cleans shoes such that dirt, stains and other foreign substances are removed.

In a second embodiment, the cleaning method or process is accomplished in a number of steps. The first step is the chemical application wherein all the appropriate chemicals are applied via a chemical application gun. The chemical application gun is designed to release chemicals in digitally proportioned increments. A digital chemical proportioning system (DCPS) combines and proportions the various cleaning chemicals that are thereafter released via the chemical application gun. Approximately two ounces of the cleaning solution are applied to each pair of shoes via the DCPS.

In applying the proper mixture of chemicals, the cleaning technician must make a determination as to the type of material or composition of the shoe (i.e., leather, suede, rubber, plastic, and fabrics) and must also make a determination as to the nature of the soil or dirt found on the shoe. Based on the dual determinations, the technician will make a final determination as to the proper chemicals and/or appropriate mixture of the chemicals.

The second step in the cleaning process encompasses the beginning of the agitation process wherein a variable speed spinning brush agitator is used to remove surface dirt from the shoe. In addition, the spinning brush is useful in agitating ground-in soil found in the shoe. The spinning brush is controlled by an electric foot pedal control unit (E.F.P.C.) located near the spinning brush. The cleaning technician controls the speed of the brush (via the E.F.P.C.) while holding the shoe against the brush such that the brush dislodges dirt from the shoe. The spinning brush has bristles which have fine abrasive granulars of different consistencies. That is, each bristle of the spinning brush has abrasives similar to those found in sand paper. The bristles can be replaced on the spinning brush has which gives the cleaning technician options in selecting different bristles for different cleaning needs. For example, for shoes with tough stains, the technician may choose bristles having coarse bristles. In addition to using the spinning brush to agitate exterior dirt, the brush is versatile in that it can be inserted within the interior of the shoe, thereby making it possible to loosen interior soil.

A third step involves the use by the technician of the pressurized steam gun or P.S.G. The P.S.G. is held by the technician approximately ¼ inches from the shoe while steam is applied first on the exterior of the shoe, then the technician works towards and into the interior of the shoe, applying steam evenly on the shoe. When working the P.S.G. within the interior of the shoe the technician first removes the sole for the shoe interior. If the sole cannot be removed than the technician proceeds with the cleaning process by inserting the P.S.G. into the interior of the shoe. In cases of heavy or stubborn stains, the technician will use the high pressure extraction unit or H.P.E.X. The H.P.E.X. can also be used on the interior of the shoe but is only used when the technician deems it necessary. The combination of the P.S.G. and H.P.E.X. in the cleaning process guarantees that normal and heavy soil can be removed in an efficient and effective manner. It should be noted that at each step or station, the technician will mark the shoe or rather the label attached to the shoe with a light pen. This light pen will record for quality assurance purposes that the particular shoe was cleaned at the associated station. Each station or step will have an associated light pen.

Figure 4:
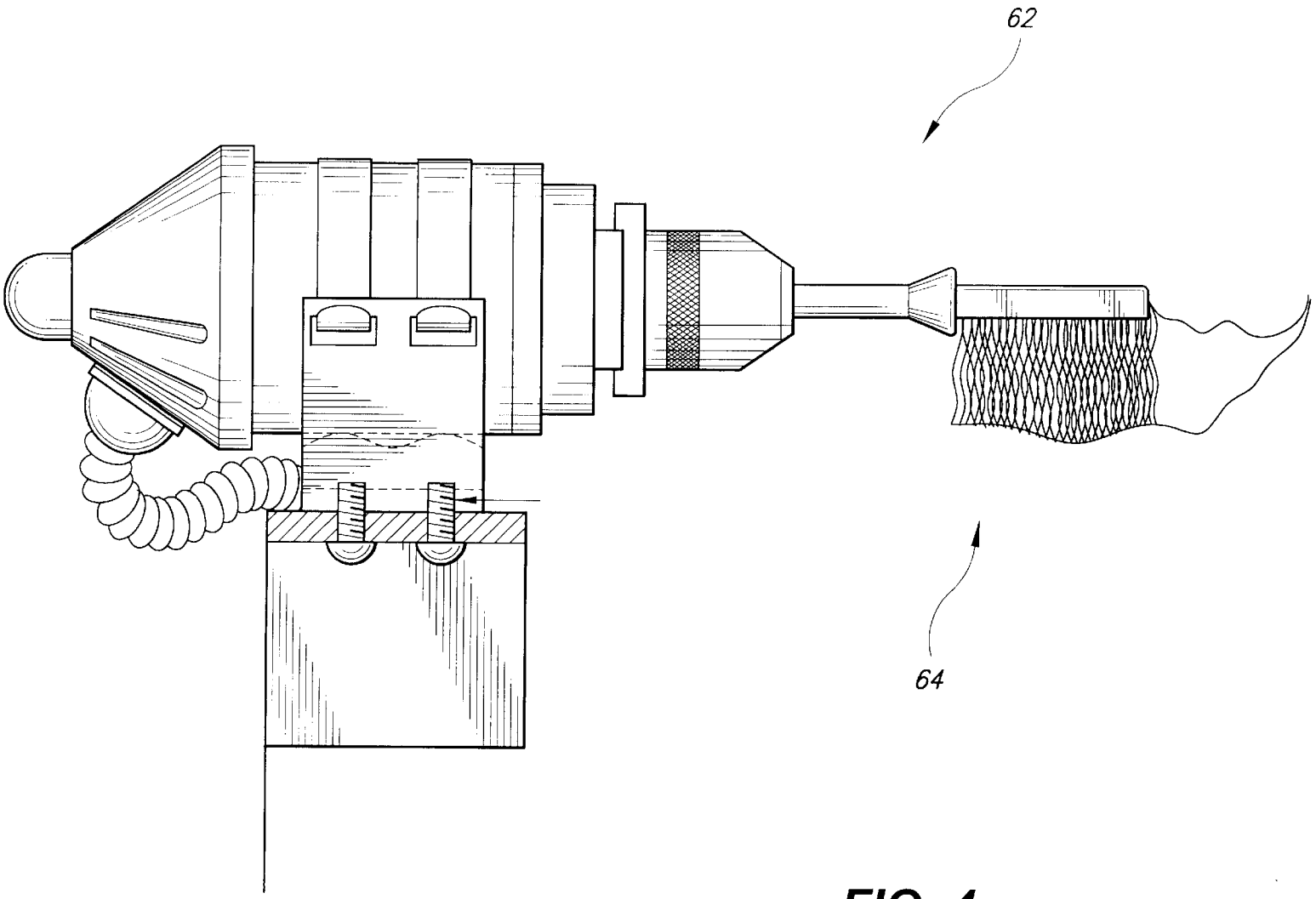
FIG. 4 is a right side view of a spinning brush tool.

Turning now to FIG. 1 of the drawings, the cleaning method is illustrated wherein the cleaning apparatus 10 is shown. The first step of the process includes applying a first chemical mist from a mixture of cleaning solutions from chemical tanks 12 via first chemical mist gun 14 to shoe 39. The user or worker cleaning the shoe depresses pedal 30 which releases the chemicals from the chemical tanks 12. Surface dirt on shoe 39 is then agitated via motorized spinning device 36 which spins brush 38. Located within spinning device 36 is a cleaning liquid (not shown) useful in breaking down or dissolving dirt from shoe 39. The introduction of the cleaning liquid and spinning device combine to remove a large portion of surface dirt. An alternative design for spinning device 36 is spinning brush 62 (of FIG. 4) that is dimensioned and configured to fit within shoe 39. Spinning device 62 is equipped with bristles (seen generally at 64) which have fine abrasive granulars of varying consistencies (similar to the varying consistencies found with different grades of sand paper). Each bristle 64 can be removed from spinning brush 62 which allows the cleaning technician to select a bristle having a different abrasive quality for use in jobs of varying magnitude.

The next step in the cleaning process is the application of high pressure air from air gun 16 via air pressure tank 22 to shoe 39. The high pressure air blows off additional dirt from shoe 39. As with the application of the first chemical mist described above, the user actuates the flow of high pressure air by depressing pedal 32 which in turn releases the high pressure air from tank 22. The preferred pressure from air pressure tank 22 is between 60 to 100 psi. The next step is the application of a second chemical mist from chemical tank 24 via chemical nozzle 18. This step is only used for special shoe fabric like suede or similar materials. Pedal 34 releases the second chemical mist from tank 24 in a similar fashion as with pedals 30, 32. Pressurized steam from steam boiler 40 is then applied, via steam gun 20, to the shoe. The pressurized steam dislodges any remaining dirt or stains from within the fabric of the shoe. The temperature of the steam should be between 250–400 degrees F. to ensure that all of the remaining dirt or stains have been dislodged from the shoe. The extraction process, which follows the application of steam, includes the vacuuming of newly dislodged dirt from shoe 39 via vacuum 28 and vacuum nozzle 26. In addition, dirt is extracted via a specialized interior upper cleaner 46 which has a specialized nozzle 44 with a plurality of holes 45 distributed along a face of the nozzle 44 to further remove excess dirt from the shoe. The tool assists the user in cleaning the interior of the shoe upper (the shoe upper is the back part of the shoe). As with foot pedals 30, 32, 34, foot pedal 42 allows the user to operate the specialized interior upper cleaner 46 by simply depressing foot pedal 42. In addition to adding to the ease of use, when foot pedals 30, 32, 34, 42 are depressed, warning lights 48 illuminate to warn the workers in the room that the associated device is being operated.

Figure 2:
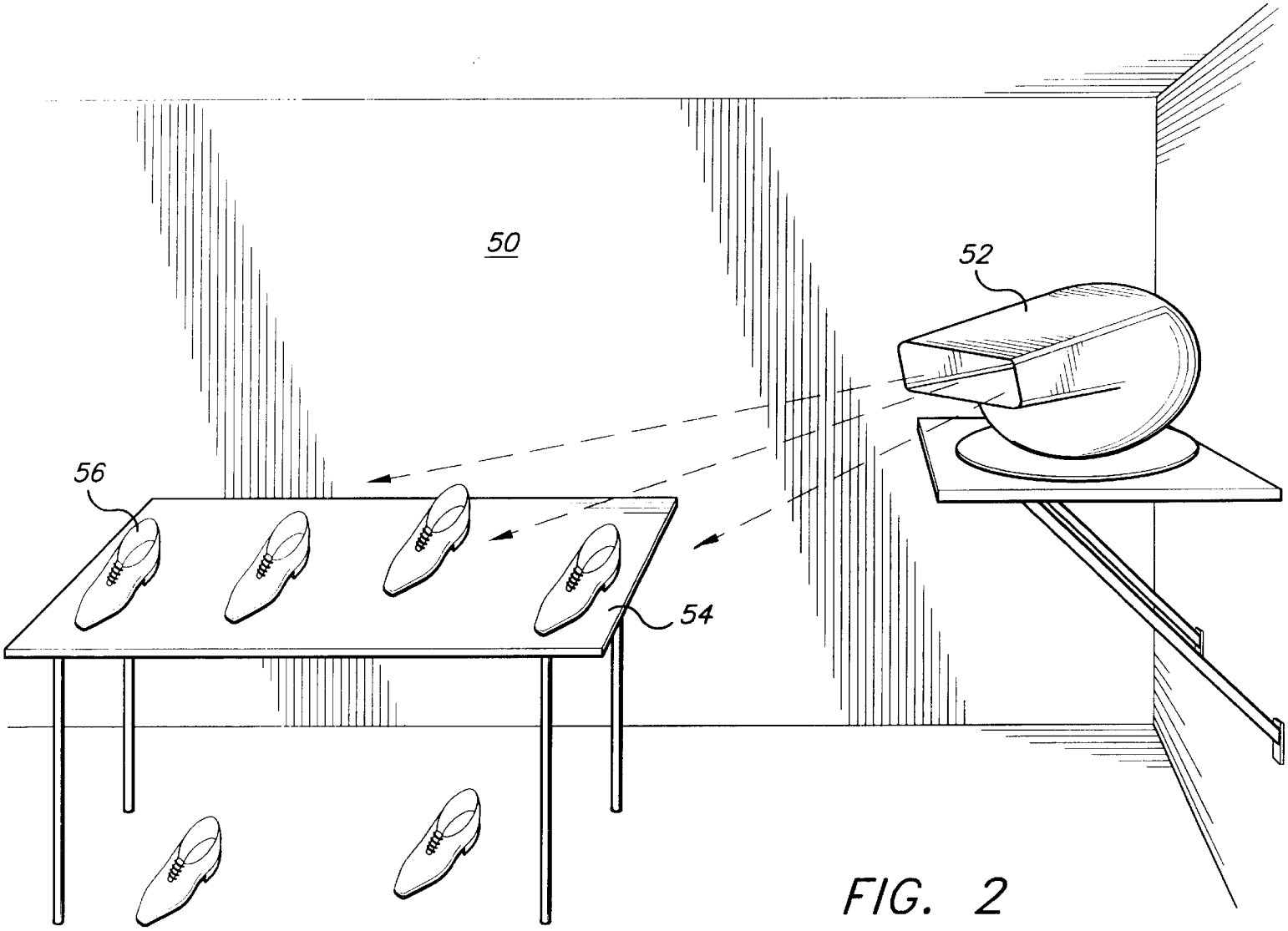
FIG. 2 is an environmental view of the drying room.

The final step is the drying step or process wherein the shoes are dried. The drying step is illustrated in FIG. 2 of the drawings wherein shoes 56 are placed upon shoe table 54 in drying room 50. A dryer 52 blows hot air over the shoes 56 to quicken the drying process of the shoes 56. Although not shown, an ionization process can be incorporated into the drying process wherein ionization is used to further remove any remaining dirt that was not removed via the disclosed cleaning method. In addition to the typical athletic shoes that can be cleaned by this process, leather shoes can also be cleaned by the use of the above mentioned method, albeit somewhat modified to account for the different tolerances associated with leather.

Figure 3:
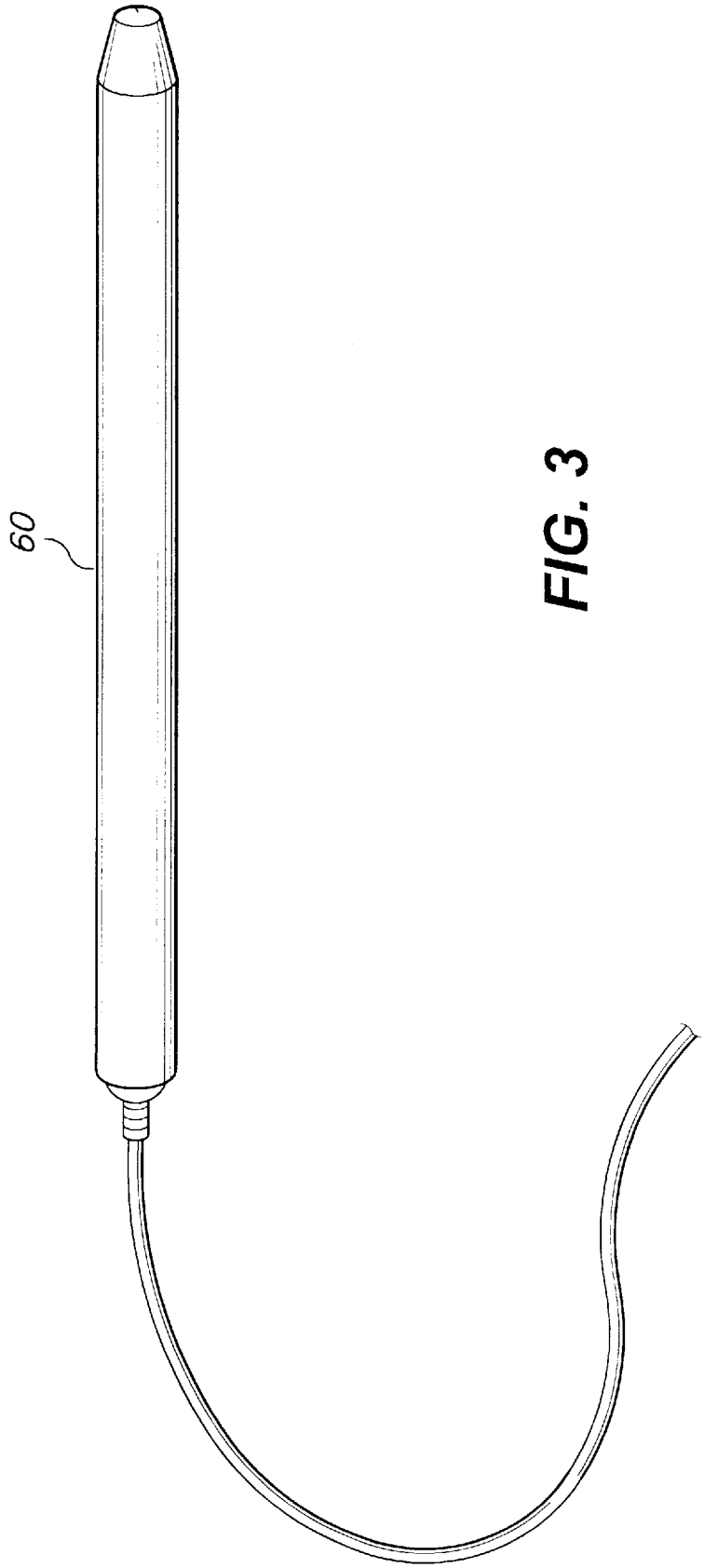
FIG. 3 is a perspective view of a light pen.

A light pen 60 (as seen in FIG. 3) is used at each station or step to record that that particular shoe was cleaned at a particular station or step. For example, after shoe 39 has been sprayed by chemical mist gun 14 the cleaning technician will use light pen 60 to register or record that shoe 39 has passed that particular station. Light pen 60 is used for quality control purposes which allows the cleaning technician supervisor to check and or determine whether the shoe 39 has been used at all the appropriate stations.

It is to be understood that the present invention is not limited to the embodiments described above, but encompasses any and all embodiments within the scope of the following claims.

I claim:

1. A method of cleaning shoes having surface dirt, normal soil, ground-in-soil and an interior upper comprising the steps of:

applying a first chemical mist to the shoe wherein said chemical mist begins to dissolve surface dirt, normal soil, heavy soil and ground-in-soil found in the shoe;

agitating the surface dirt via a spinning brush wherein said agitating of the surface dirt loosens the surface dirt and also loosens ground-in-soil found in the shoe;

applying high pressure air to remove surface dirt from the shoe;

applying a second chemical mist to the shoe wherein said second chemical mist is used to help disslove heavy soil and ground-in-soil;

applying pressurized steam to the shoe to remove normal soil and heavy soil found in the shoe;

applying suction via a vacuum device for extracting dirt from the shoe;

applying an interior upper cleaning tool to clean said interior upper of the shoe; and applying a drying step to dry the shoes.

2. The method of cleaning shoes according to claim 1 wherein said high pressure air is pressurized within a tank at between 60 to 100 psi.

3. The method of cleaning shoes according to claim 1, wherein said first chemical mist is applied via a chemical mist gun and wherein said second chemical mist is applied via a chemical nozzle and wherein said pressurized steam is applied via a steam gun.

4. The method of cleaning shoes according to claim 3, wherein said pressurized steam has a temperature of between 250 to 450 degrees F.

5. The method of cleaning shoes according to claim 1 wherein said spinning brush is dimensioned and configured to fit within the shoe.

6. The method of cleaning shoes according to claim 1 further comprising the step of using a light pen to record for quality assurance purposes when a shoe has been cleaned at a particular station.

7. The method of cleaning shoes according to claim 1 wherein said drying step comprises placing the shoes upon shoe table in a drying room and blowing hot air over the shoes for drying.

8. A method of cleaning shoes having a composition where the method cleaning shoes comprising the steps of:

applying digitally proportioned chemicals to shoes via a chemical application gun;

determining the composition of the shoe and dirt thereupon and based upon the determinations, applying chemicals to the shoes;

agitating the dirt on the shoe via a variable speed spinning brush wherein said variable speed spinning brush is dimensioned and configured to fit within the shoes;

applying pressurized steam to the shoe via a pressurized steam gun;

applying the pressurized steam gun first on an exterior of the shoe and then within an interior of the shoe; and using a light pen to record for quality assurance each instance of the shoe being cleaned.

9. The method of cleaning shoes according to claim 8 wherein said variable speed spinning brush has a plurality of bristles having fine abrasive granulars similar to those found in sand paper.

10. The method of cleaning shoes according to claim 9 wherein each of said plurality of bristles can be replaced on said variable speed spinning brush.

11. The method of cleaning shoes according to claim 10 wherein said variable speed spinning brush is controlled by a foot pedal.

12. The method of cleaning shoes according to claim 8 wherein said pressurized steam gun is held approximately ¼ inches from the shoes while steam is being applied to the shoes.

13. The method of cleaning shoes according to claim 8, further comprising the step of applying high pressure suction to the shoes.

* * * * *